US005609172A

United States Patent [19]

Chang et al.

[11] Patent Number: 5,609,172

[45] Date of Patent: Mar. 11, 1997

[54] WASHING WATER FILTERING APPARATUS FOR DISH WASHING MACHINE

[75] Inventors: Jae W. Chang, Kyungki-do; Joon W. Kim, Seoul, both of Rep. of Korea

[73] Assignee: LG Electronics Inc., Rep. of Korea

[21] Appl. No.: 580,507

[22] Filed: Dec. 28, 1995

[30] Foreign Application Priority Data

Jan. 7, 1995 [KR] Rep. of Korea ..... 19237/1995
Jan. 9, 1995 [KR] Rep. of Korea ..... 28588/1995

[51] Int. Cl.[6] ..... B08B 3/02

[52] U.S. Cl. ..... 134/57; 134/58 D; 134/104.1; 134/111; 210/412

[58] Field of Search ..... 134/104.1, 104.4, 134/56 R, 57 D, 58 D, 111; 210/408, 412, 407

[56] References Cited

U.S. PATENT DOCUMENTS

| | | | |
|---|---|---|---|
| 3,457,929 | 7/1969 | Madden | 134/111 |
| 3,491,780 | 1/1970 | Kladenberg | 134/111 |
| 3,810,480 | 5/1974 | Smith | 134/104.1 |
| 3,989,054 | 11/1976 | Mercer | 134/104.1 |
| 4,612,947 | 9/1986 | Duncan | 134/104.1 |
| 5,165,433 | 11/1992 | Meyers | 134/111 |

FOREIGN PATENT DOCUMENTS

| | | | |
|---|---|---|---|
| 2449814 | 4/1976 | Germany | 134/104.1 |
| 3723721 | 5/1988 | Germany | 134/104.1 |

OTHER PUBLICATIONS

European Patent Application 198,496 Oct. 1986.

*Primary Examiner*—Frankie L. Stinson
*Attorney, Agent, or Firm*—Ostrolenk, Faber, Gerb & Soffen, LLP

[57] ABSTRACT

An improved washing water filtering apparatus for a dish washing machine capable of preventing nets of a washing water filter from being clogged by wastes, so that it is not necessary to clean the nets of a washing water filter after using the dish washing machine, and preventing water pollution by effectively filtering the washing water of the dish washing machine, which includes a waste gathering box having a drain opening formed at an inner wall thereof and connected to a drainpipe and having an introduction tube disposed at a lower inner wall thereof for receiving washing water and wastes, such as food debris; a driving motor disposed at a lower portion of the waste gathering box; a rotary shaft connected to an upper portion of the driving motor and partially inserted into the interior of the waste gathering box and having an upper impeller disposed at an upper portion thereof; a lower impeller disposed at a lower portion of the waste gathering box and spaced apart from the upper impeller and connected to the rotary shaft; a separating tube disposed at an outer portion of the rotary shaft disposed between the upper impeller and the lower impeller; a flow direction control value disposed between an inner surface of the separating tube and an outer surface of the rotary shaft; and a microfilter extended from an outer surface of the separating tube and an inner surface of the waste gathering box, the microfilter being hollow and ring-shaped.

5 Claims, 4 Drawing Sheets

WASHING WATER FILTERING APPARATUS FOR DISH WASHING MACHINE

BACKGROUND OF THE INVENTION

1. Field of the Invention

The present invention relates to a washing water filtering apparatus for a dish washing machine, and particularly to an improved washing water filtering apparatus for a dish washing machine capable of preventing filters from being clogged by wastes, so that it is not necessary to clean the filters after a dish washing operation is completed, and preventing water pollution by effectively filtering the washing water of the dish washing machine.

2. Description of the Conventional Art

FIG. 1 shows a conventional dish washing machine equipped with a washing water filtering apparatus, which includes a downwardly protruded cylindrical waste gathering box 1*a* formed at the lower surface of a casing 1 constituting a body of a dish washing machine.

A dish rack 2 is disposed at an upper portion inside the casing 1.

A spray arm 11 having a plurality of spray nozzles 12 a disposed at an inner lower portion of the casing 1 so as to spray washing water upwardly.

A side opening 3*a* having an introduction tube 6 is formed at the side surface of the waster gathering box 1*a*.

In addition, a drain opening 3*b* is formed at the bottom of the waste gathering box 1*a*, and a drainpipe 8 is connected to the drain opening 3*b*.

A conical shape fine-meshed filter 4 is provided at the upper portion of the waste gathering box 1*a* for filtering food particles.

The lower portion of the waste gathering box 1*a* is connected to the drainpipe 3*b* disposed below the waste gathering box 1*a*.

Meanwhile, a coarse filter 5 is disposed at the lower portion of the fine-meshed filter 4 for filtering bigger size of food particles.

In addition, a circulation pump 7 is connected to the introduction tube 6, and the circulation pump 7 and the spray arm 11 is connected by an ejecting tube 10.

A drain pump 9 is disposed at the drainpipe 8 for draining washing water filtered by the fine-meshed filter 4.

The operation of the washing water filtering apparatus for a dish washing machine will now be explained with reference to the accompanying drawings.

Dishes (not shown) to be washed are placed on the rack 2, and washing water and detergent are properly provided in the dish washing machine.

When water supply operation is finished, the circulation pump 7 pumps washing water to the spray arm 11 through the ejecting tube 10, and the washing water introduced into the spray arm is sprayed upwardly inside the casing 1 through the spray nozzles 12, so that dishes on the rack 2 are washed.

Food particles contained in washing water gather on the bottom of the casing 1, and filtered by the coarse filter 5.

In addition, more smaller food particles of waste are filtered by the fine-meshed filter 4, and washing water of which smaller food particles are filtered is introduced into the spray arm by the circulation pump, and sprayed upwardly inside the casing 1.

When the above-mentioned dish washing operation is finished, the circulation pump 7 stops, and the drain pump 9 is operated, and washing water and wastes gathered at the bottom of the fine-meshed filter 4 by the drain pump 9 are introduced to the outside of the waste gathering box 1*a* through the drain tube 8.

The above-mentioned operation is finished, a dish rinsing operation is performed. That is, rinsing water is supplied inside the casing 1 in the same manner as the washing water supply operation in cooperation of the circulation pump 7.

After the above-mentioned rinsing water supply operation is finished, a dish dry operation is performed.

The full line arrow of FIG. 1B indicates flows of the washing water when the drain pump operates, and the broken line arrow of FIG. 1B indicate flow of the washing water when the drain pump is not operated.

However, the conventional dish washing machine has disadvantages in that since the washing water containing food particles are filtered by the fine-meshed filter 4 and re-supplied to the dish rack in cooperation with the circulation pump 7, when wastes is filtered by the fine-meshed filter 4, food particles gather at only one side of the fine-meshed filter by suction force of the circulation pump 7.

In more detail, when viewing the food particles gathering process from the line C—C of FIG. 1A which is a center line of the fine-meshed filter 4, food particles gather at the inner circumferential surface 4*a* of the fine-meshed filter 4 at the side of the circulation pump 7 generating suction force, and at the opposed side, the food particles gather at the outer circumferential portion of the fine-meshed filter 4.

Therefore, the food particles gathered at the inner circumferential portion of the fine-meshed filter by the forcing flow of the washing water containing solid particles are filtered by the drain tube. However, food particles gathered at the outer circumferential portion remain because the flow direction of the washing water is the same as the filtering flow of the washing water, the food particles still gather there. When finishing a user should inconveniently remove the food particles.

In addition, when the nets of the filters are clogged by the food particles, the load of the washing pump increases, effective dish washing operation can not be achieved.

SUMMARY OF THE INVENTION

Accordingly, it is an object of the present invention to provide a washing water filtering apparatus for a dish washing machine, which overcome the problems encountered in a conventional washing water filtering apparatus for a dish washing machine.

It is another object of the present invention to provide an improved washing water filtering apparatus for a dish washing machine capable of preventing filters from being clogged by wastes, so that it is not necessary to clean the filters after a dish washing operation is completed, and preventing water pollution by effectively filtering the washing water of the dish washing machine.

To achieve the above objects, in accordance with a first embodiment according to the present invention, there is provided a washing water filtering apparatus for a dish washing machine, which includes a waste gathering box having a drain opening formed at an inner wall thereof and connected to a drainpipe and having an introduction tube disposed at a lower inner wall thereof for receiving washing water and wastes, such as food debris, the waste gathering box being cylindrical; a driving motor disposed at a lower portion of the waste gathering box; a rotary shaft connected to an upper portion of the driving motor and partially inserted into the interior of the waste gathering box and having an upper impeller disposed at an upper portion thereof, the upper impeller being a circular plate type; a lower impeller disposed at a lower portion of the waste gathering box and spaced apart from the upper impeller and connected to the rotary shaft, the lower impeller being a circular plate type; a separating tube disposed at an outer portion of the rotary shaft disposed between the upper impeller and the lower impeller, the separating tube being hollow and cylindrical; a flow direction control value disposed between an inner surface of the separating tube and an outer surface of the rotary shaft; and a microfilter extended from an outer surface of the separating tube and an inner surface of the waste gathering box, the microfilter being hollow and ring-shaped.

To achieve the above objects, in accordance with a second embodiment according to the present invention, there is provided a washing water filtering apparatus for a dish washing machine, which includes a waste gathering box having a coarse filter, a fine-meshed filter, and a passing-through opening formed at an inner surface thereof for receiving washing water and wastes such as food debris; a drain pump disposed below the waste gathering box; a filter disposed at an inner surface of the waste gathering box; a washing water circulation tube connected between a lower portion of the drain pump and the filter; a suction tube connected between a certain portion of the drain pump and a certain portion of the waste gathering box; and a washing water and wastes drain tube connected between a certain portion of the suction tube and a certain portion of the filter.

DETAILED DESCRIPTION OF THE INVENTION

Since the construction of the casing of the dish washing of the present invention is the same as the conventional art, only the washing water filter apparatus will be explained.

Figure 1A:
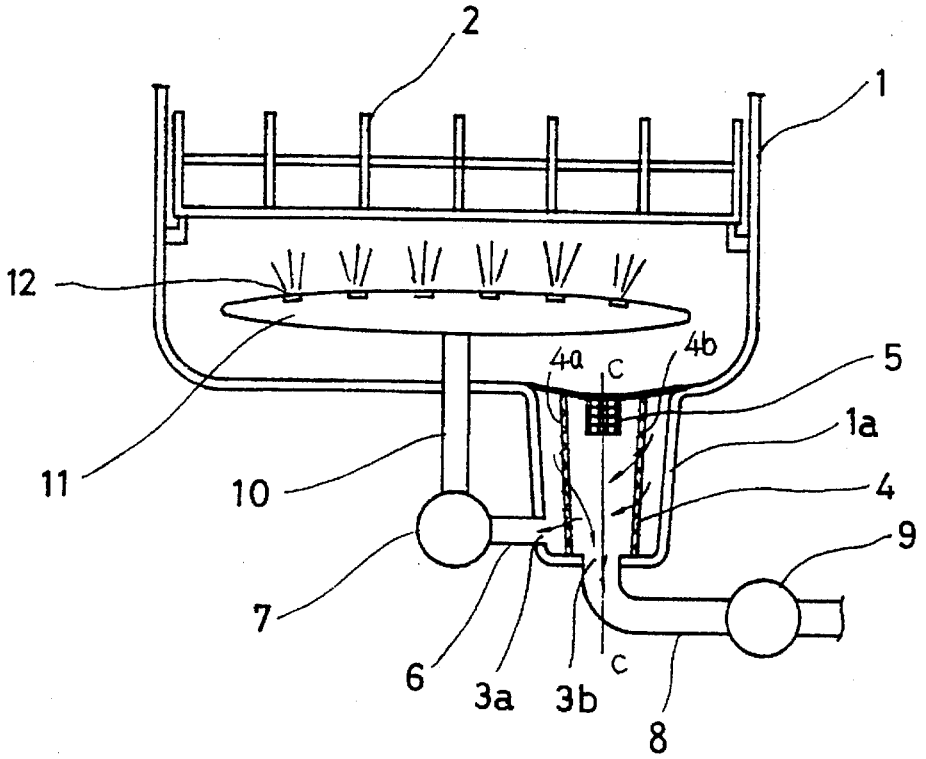
FIG. 1A CONVENTIONAL ART
FIG. 1 is a cross-sectional view showing a conventional dish washing machine equipped with a washing water filtering apparatus.
FIG. 1B is a cross-sectional view showing a washing water filtering apparatus of FIG. 1A in more detail.
Figure 1B:
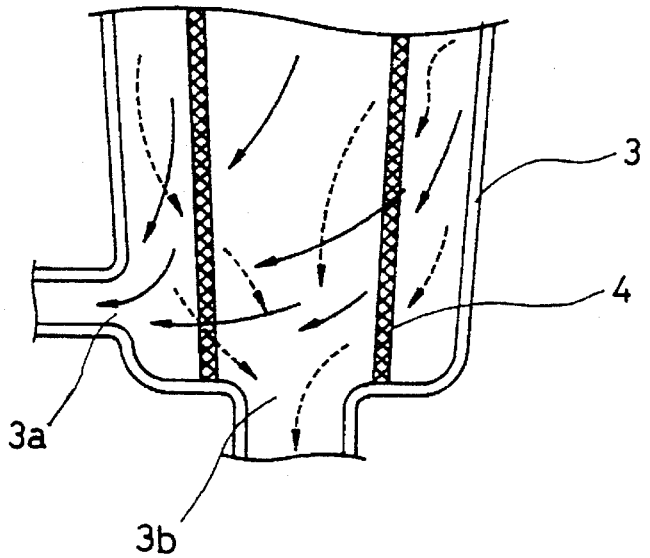
FIG. 1B CONVENTIONAL ART
Figure 2A:
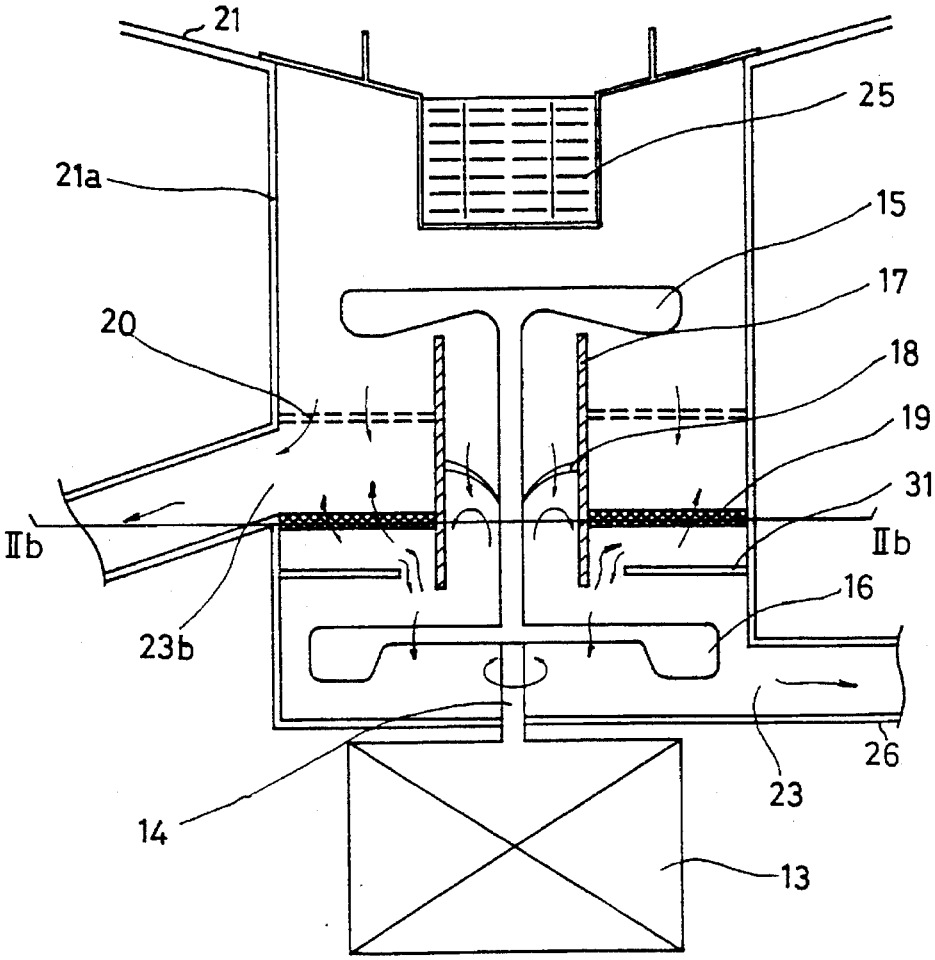
FIG. 2A is a cross-sectional view showing a washing water filtering apparatus of a dish washing machine according to the present invention.
Figure 2B:
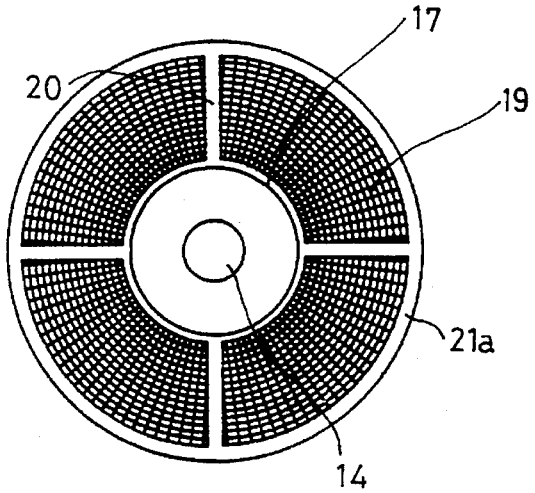
FIG. 2B is a cross-sectional view taken from line IIb—IIb of FIG. 2A according to the present invention.

FIG. 2 shows a washing water filtering apparatus for a dish washing machine of a first embodiment according to the present invention, which includes a waste gathering box 21*a* disposed at the bottom of a casing 21 for receiving washing water and food particles.

A coarse filter 25 for filtering bigger food particles is placed on the entrance portion of the waste gathering box 21*a*.

In addition, a drain opening 23*b* connected to a drain tube 28 is formed at the side wall of the waste gathering box 21*a*, and a passing-through opening 23*a* connected to a circulation opening (not shown) is formed at the side wall of the waste gathering box 21*a* for re-spraying the washing water, and an introduction tube 26 is connected to the passing-through opening 23*a*.

In addition, a driving motor 13 is disposed below the waste gathering box 21*a*, and a rotary shaft 14 is connected to a certain portion of the driving motor 13 and partially inserted into the waste gathering box 21*a*.

An upper impeller 15 having a plurality of blades is disposed at the upper portion of the rotary shaft 14. The upper impeller 15 is also disposed below the coarse filter 25.

In addition, a lower impeller 16 having a plurality of spaced-apart blades and connected to the rotary shaft 14 is disposed below the waste gathering box 21*a*.

In addition, a hollow cylindrical separating tube 17 is disposed at the output portion of the rotary shaft 14 disposed between the upper impeller 15 and the lower impeller 16, and a flow direction control valve 18 is disposed between the inner circumferential surface of the separating tube 17 and the outer circumferential surface of the rotary shaft 14 for controlling the flow of the washing water.

The flow direction control valve 18 is properly the check valve.

A support member 20 is disposed at a certain portion of the upper outer surface of the separating tube for supporting the separating tube 17.

In addition, a hollow ring-shaped microfilter 19 is extended from the outer circumferential portion of the separating tube 17 and the inner circumferential portion of the waste gathering box 21*a*.

The microfilter 19 is disposed below the drain opening 23*b* formed at the side surface of the waste gathering box.

In addition, a control plate 31 is disposed at the inner surface of the waste gathering box 21*a* for guiding the flow of the washing water and is also disposed below the microfilter 19. Here, the control plate 31 is spaced apart from the outer surface of the separating tube 17.

The operation of the washing water filtering apparatus for a dish washing machine of the first embodiment according to the present invention will now be explained with reference to the accompanying drawings.

To begin with, after placing dish on the rack of the dish washing machine, detergent and washing water are supplied to the system. When the circulation pump (not shown) and the driving motor 13 are driven. Washing water are sprayed onto the dish on the rack, and the dish are properly washed.

The washing water containing food particles are introduced at the waste gathering box 21*a* of the casing 21, and bigger food particles are first filtered by the coarse filter 25 disposed at the upper portion of the waste gathering box 21*a*.

The thusly filtered washing water is forced to move toward the outside of the center of the waste gathering box 21*a* by the centrifugal force of the upper impeller 15 driven by the driving motor 13.

Therefore, washing water containing many food particles gathers at the outer portion of the upper impeller 15, and washing water containing less food particles gathers at the center portion of the upper impeller 15. That is, cleaner washing water gathers at the center portion of the upper impeller 15.

The washing water gathered at the center portion of the upper impeller 15 is introduced into the waste gathering box 21*a* through the center portion of the separating tube 17, and is introduced into the introduction tube 26 through the passing-through opening 23*a* disposed at the bottom of the waste gathering box 21*a* and re-sprayed toward the inside of the casing in cooperation with the rotation force of the lower impeller 16 which rotates together with the upper impeller 15.

Meanwhile, the washing water containing many food particles gathered at the outer portion of the upper impeller 15 is filtered by the microfilter 19, and the thusly filtered washing water is introduced into the waste gathering box 21*a* through a path formed between the outer surface of the separating tube 17 and the control plate 31, and is re-sprayed into the inside of the casing through the passing-through opening 23*a* in cooperation with the lower impeller 16.

The above-mentioned filtering processes are repeatedly executed, and the dishes on the rack are washed.

After the above-mentioned dish washing operation is completed, a washing drain process is executed.

That is, when the drain process is performed, the circulation pump stops, and the driving motor 13 reversely rotates, and at the same time, the drain pump (not shown) operates.

The reverse rotation of the driving motor 13 is directed to reversely rotating the lower impeller 16 and moving the washing water in the lower portion of the waste gathering box 21*a* toward the upper portion thereof.

The upwardly moving water causes a wastes clogging on the upper surface of the microfilter 19 to depart therefrom, and the thusly departed food particles are introduced into the drain opening 23*b* and the drain tube 28.

At this time, the washing water flowing into the separating tube 17 by the driving force of the lower impeller 16 is blocked by the flow direction control valve 18 disposed at the inner portion of the separating tube 17.

As described above, the washing water filtering apparatus for a dish washing machine of the first embodiment according to the present invention is directed to filtering the washing water in cooperation with the centrifugal force of the upper impeller, effectively re-spraying clearer washing water, and automatically draining the wastes by causing clogging wastes to depart from the upper surface of the microfilter in cooperation with the reverse rotation of the lower impeller, so that it is possible to prevent wastes from clogging the filters.

Therefore, this embodiment of the present invention provides a user with convenient dish washing functions. That is, it is not necessary to clean the filers, so that it is possible to achieve better reliability of the products.

Figure 3:
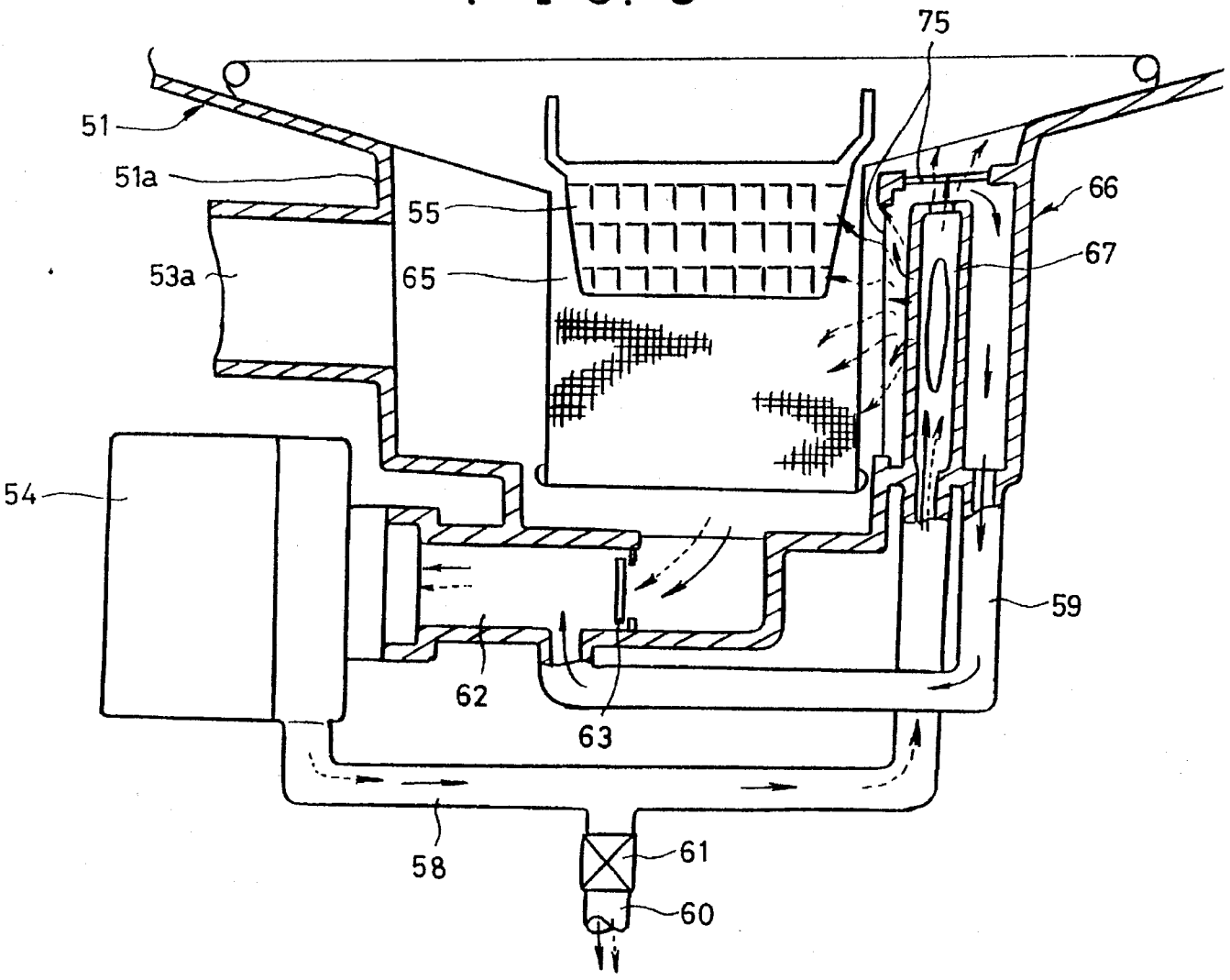
FIG. 3 is a cross-sectional view of a dish washing machine equipped with a washing water filtering apparatus so as to show flows of washing water according to the present invention.

FIG. 3 shows a washing water filtering apparatus for a dish washing machine of a second embodiment according to the present invention, which includes a waste gathering box 51*a* disposed at the bottom of the washing tub 51 for introducing washing water and wastes thereinto.

A cylindrical coarse filter 55 for first filtering bigger food particles is disposed at the entrance of the waste gathering box 51*a*.

A fine-meshed filter 65 is disposed below the coarse filter 55 for filtering smaller food particles passed through the coarse filter 55.

In addition, a passing-through opening 53*a* connected to a circulation pump (not shown) is disposed at the side wall of the waste gathering box 51*a* for re-spraying washing water.

In addition, a drain pump 54 is disposed below the washing tub 51 for circulating washing water passed through the fine-meshed filter 65 and for draining polluted washing water.

In addition, a microfilter 75 having a chamber 66 is disposed at one side of the washing tub 51, that is, at the opposed portion of the drain pump 54, for filtering smaller food particles contained in washing water which is recirculated by the drain pump 54.

A spray nozzle 67 is disposed within the chamber 66 of the microfilter 75.

The lower portion of the chamber 66 is connected to the lower portion of the drain pump 54 by a washing water circulation tube 58.

Meanwhile, the bottom of the washing tub 51 and the one side of the drain pump are connected by a suction tube 62.

The lower portion of the suction tube 62 and the chamber 66 having the nozzle 67 are connected by a waste water drain tube 59, and a check valve 63 is disposed at a periphery of the suction tube 62 for permitting the flow of the washing water from the washing tub 51 to flow in the direction of the drain pump 54.

In addition, a drainpipe 60 and the drain valve 61 are disposed at a periphery of the washing water circulation tube 58 for draining wasters and washing water.

The operation of the washing water filtering apparatus for a dish washing machine of a second embodiment according to the present invention will now be explained with reference to the accompanying drawings.

To begin with, the washing water polluted through dish washing processes flows toward the coarse filter 55.

At this time, bigger food particles contained in the washing water is filtered by the coarse filter 55 and smaller food particles contained in the washing water is filtered by the fine-meshed filter 65.

In the above-mentioned state, when the drain pump 54 operates, the washing water passed through the fine-meshed filter 65 is introduced into the suction tube 62, and flows toward the nozzle 67 through the drain pump 54 and the washing water circulation tube 58.

At this time, the drain valve 61 disposed at the washing water circulation tube 58 is closed.

Figure 4:
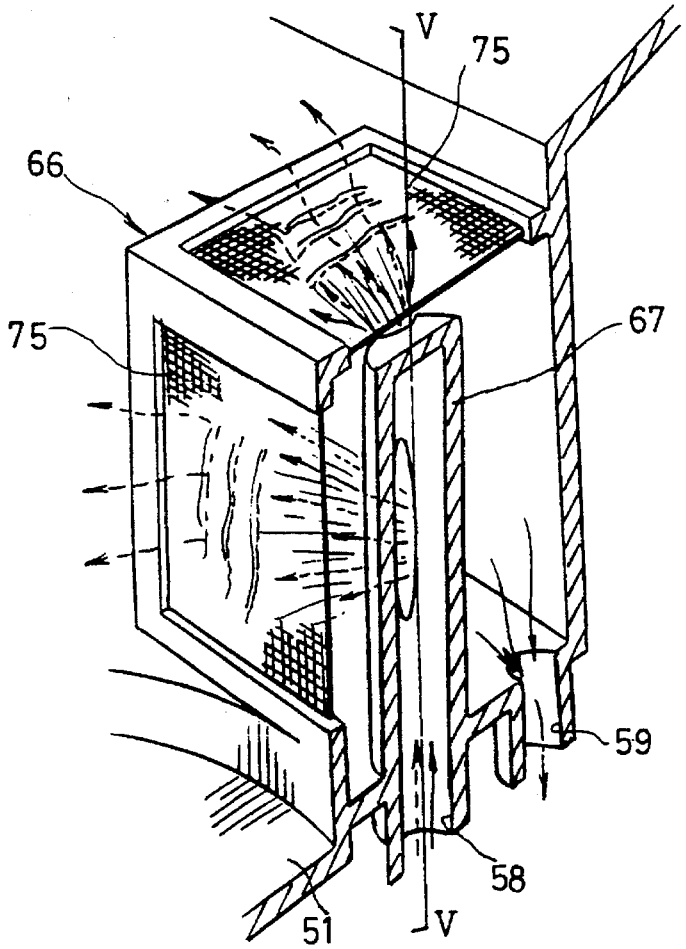
FIG. 4 is a cross-sectional view showing a spray nozzle of a washing water filtering apparatus of a dish washing machine according to the present invention.
Figure 5:
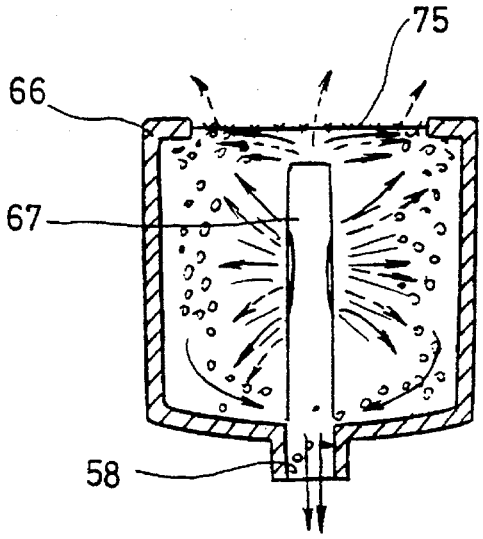
FIG. 5 is a cross-sectional view taken from line IV—IV of FIG. 4 according to the present invention.

The washing water flown to the nozzle 67 is sprayed toward the microfilter 75 in the chamber 66, and wastes contained in the washing water is filtered by the microfilter 75 and introduced into the suction tube 62 of the drain pump 54, and the cleaned washing water is sprayed toward the fine-meshed filter 65 as shown in FIGS. 4 and 5.

The polluted washing water supplied toward the suction tube 62 is blocked to flow to the inside of the washing tub 51 by the pumping force of the drain pump 54, and when the drain pump 54 stops, the polluted washing water is blocked to flow to the inside of the washing tub 51 in cooperation with the check valve 63.

Meanwhile, when food particles clog the microfilter 75, since the inner pressure of the chamber 66 is increased, the filters clogging phenomenon might increase.

However, it is possible to prevent food particles from clogging the microfilter 75 by spraying washing water in the direction parallel to the microfilter 75 using the spray nozzle 67.

In addition, it is also possible to prevent food particles from clogging the filters by providing a valve capable of changing the diameter of the entrance portion of the washing water circulation tube 58 connected to the spray nozzle 67.

Meanwhile, it is possible to drain polluted washing water to the outside of the machine by opening the drain valve 61 at the time of washing water drain. In addition, it is possible to clean the microfilter 75 by spraying washing water onto the microfilter 75 by forcing part of the washing water to flow toward the nozzle 67 through the polluted water drainpipe 59.

Therefore, polluted water in the chamber can de drained to the outside of the machine.

As described above, the washing water filtering apparatus for a dish washing machine of a second embodiment according to the present invention is directed to effectively preventing food particles from clogging the coarse filter and the fine-meshed filter and dish from being polluted by preventing polluted washing water from being sprayed onto dishes again. In addition, it is not necessary to clean the fine-meshed filter after washing dishes on the rack. Moreover, it is possible to achieve washing water reduction and convenient dish washing operation by automatically cleaning the filters.

Although the preferred embodiments of the present invention have been disclosed for illustrative purposes, those skilled in the art will appreciate that various modifications, additions and substitutions are possible, without departing from the scope and spirit of the invention as described in the accompanying claims.

What is claimed is:

1. A washing water filtering apparatus for a dish washing machine, comprising:

a waste gathering box having a coarse filter, a fine-meshed filter, and a passing-through opening formed at an inner surface thereof for receiving washing water and wastes such as food debris;

a drain pump disposed below said waste gathering box;

filtering means disposed at an inner surface of the waste gathering box;

a washing water circulation tube connected between a lower portion of said drain pump and said filtering means;

a suction tube connected between a certain portion of the drain pump and a certain portion of the waste gathering box; and a washing water and wastes drain tube connected between a certain portion of said suction tube and a certain portion of the filtering means.

2. The apparatus of claim 1, wherein said filtering means includes a chamber, a microfilter disposed at an outer surface of said chamber, and a spray nozzle disposed in the interior of the chamber.

3. The apparatus of claim 1, wherein said suction tube includes a check valve disposed at a certain portion thereof for permitting washing water to flow in a certain direction flown from the waste gathering box, said check value permitting washing water to flow in the direction of a drain pump.

4. The apparatus of claim 1, wherein said washing water circulation tube includes a drainpipe and a drain valve for draining polluted washing water and wastes.

5. The apparatus of claim 1, wherein said washing circulation tube includes a valve capable of changing the diameter of the washing water circulation tube.

* * * * *